US010306930B2

(12) United States Patent
Qiu

(10) Patent No.: US 10,306,930 B2
(45) Date of Patent: Jun. 4, 2019

(54) HEATING DEVICE, AND ATOMIZING HEAD, ATOMIZER AND ELECTRONIC CIGARETTE HAVING THE SAME

(71) Applicant: Joyetech Europe Holding GmbH, Zug (CH)

(72) Inventor: Weihua Qiu, Jiangsu (CN)

(73) Assignee: Joyetech Europe Holding GmbH, Zug (CH)

( * ) Notice: Subject to any disclaimer, the term of this patent is extended or adjusted under 35 U.S.C. 154(b) by 0 days.

(21) Appl. No.: 15/623,646

(22) Filed: Jun. 15, 2017

(65) Prior Publication Data

US 2018/0360112 A1 Dec. 20, 2018

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2006.01) |
| ***H05B 3/42*** | (2006.01) |
| *H05B 3/04* | (2006.01) |

(52) U.S. Cl.

CPC ..... *A24F 47/008* (2013.01); *H05B 3/42* (2013.01); *H05B 3/04* (2013.01); *H05B 2203/021* (2013.01)

(58) Field of Classification Search

CPC ..... A24F 47/008; A24F 47/002; H05B 3/42; H05B 3/04; H05B 2203/021

USPC ..... 131/329, 328

See application file for complete search history.

(56) References Cited

U.S. PATENT DOCUMENTS

| | | | | |
|---|---|---|---|---|
| 9,814,272 | B2 * | 11/2017 | Li | B67D 99/00 |
| 9,861,132 | B2 * | 1/2018 | Li | H05B 3/48 |
| 9,888,727 | B2 * | 2/2018 | Li | A24F 47/008 |
| 2015/0305408 | A1 * | 10/2015 | Liu | H05B 3/44 131/329 |
| 2016/0106153 | A1 * | 4/2016 | Zhu | A24F 47/008 131/329 |
| 2016/0135505 | A1 * | 5/2016 | Li | H05B 3/44 131/329 |
| 2016/0143358 | A1 * | 5/2016 | Zhu | A24F 47/008 131/329 |
| 2016/0157522 | A1 * | 6/2016 | Zhu | A24F 47/008 131/329 |
| 2017/0105454 | A1 * | 4/2017 | Li | A24F 47/008 |
| 2018/0027881 | A1 * | 2/2018 | Chen | A24F 47/008 |
| 2018/0035720 | A1 * | 2/2018 | Qiu | A24F 47/008 |

FOREIGN PATENT DOCUMENTS

| | | | |
|---|---|---|---|
| CN | 204426698 | U | 7/2015 |
| CN | 104970444 | A | 10/2015 |
| CN | 105212279 | A | 1/2016 |
| CN | 105394814 | A | 3/2016 |

* cited by examiner

*Primary Examiner* — Hae Moon Hyeon

(74) *Attorney, Agent, or Firm* — Novick, Kim & Lee, PLLC; Allen Xue

(57) ABSTRACT

A heating device for an atomizing head of electronic cigarette is disclosed, including a sleeve-shaped heating element, and a liquid absorbing component wrapping around an outer surface of the heating element, the liquid absorbing component is formed by at least two liquid absorbing elements engaging each other. It is only required to position the liquid absorbing elements of the liquid absorbing component on the outer surface the heating element and engage the liquid absorbing elements together during assembling. The assembly can be quick and simple.

7 Claims, 2 Drawing Sheets

HEATING DEVICE, AND ATOMIZING HEAD, ATOMIZER AND ELECTRONIC CIGARETTE HAVING THE SAME

FIELD

The present disclosure relates to the field of electronic cigarette, and more particularly, to a heating device for an atomizing head of an electronic cigarette, an atomizing head, an atomizer, and an electronic cigarette.

BACKGROUND

At present, electronic cigarettes have become more mature substitutes for cigarette in the market. When heating wire in the atomizing head is powered by a battery, the heating wire can be electrically driven to heat the tobacco liquid to produce smoke, therefore users can get a smoking experience.

Recently, an atomizing head of the electronic cigarette has been developed to have a heating device with a heating wire covered by a porous ceramic material which is used to absorb and store the tobacco liquid, that is, the heating wire is inserted into the porous ceramic material. However, the porous ceramic material in the conventional heating device is formed as a whole, so that when the heating wire is being inserted into the porous ceramic material, there is easy to appear a phenomenon that the heating wire is unable to be assembled into the porous ceramic material since the size of the heating wire does not match the size of the porous ceramic material, thereby reducing the efficiency of assembling.

SUMMARY

The technical problem to be solved by the present disclosure is to provide a heating device for an atomizing head or an electronic cigarette, which is easy to assemble and has the advantage of high assembling efficiency. The present disclosure also provides an atomizing head using the heating device, and an atomizer using the atomizing head and an electronic cigarette using the atomizer.

In order to solve the above-mentioned technical problem, the present disclosure provides a heating device for an atomizing head of an electronic cigarette, including a sleeve-shaped heating element, and a liquid absorbing component wrapping around an outer surface of the heating element, wherein the liquid absorbing component is formed by at least two liquid absorbing elements engaging each other.

Furthermore, each liquid absorbing component is curved, and the at least two liquid absorbing elements engaging each other to form a sleeve that wraps around the outer surface of the heating element.

Moreover, each liquid absorbing component is made of a porous ceramic material.

The present disclosure also provides an atomizing head of an electronic cigarette, including a mounting base and a heating device as described above, wherein the heating device is provided inside the mounting base, and the mounting base is provided with an inlet passage for guiding tobacco liquid to the liquid absorbing component.

Additionally, the mounting base is in a sleeve shape, the heating device is provided inside the mounting base, the inlet passage is provided on a side wall of the mounting base, and a positioning element for fastening the liquid absorbing component is provided between the mounting base and the heating device.

Further, the positioning element is a cotton cloth or cotton wrapping around the outer surface of the liquid absorbing component.

Furthermore, the atomizing head further includes a cover provided on one end of the mounting base, and a seal component is provided between the cover and the liquid absorbing component.

Furthermore, the atomizing head further includes an electrical contact adapted to be electrically connected to an anode or cathode of a power supply, the electrical contact is connected to other end of the mounting base away from the cover, one terminal of the heating element is electrically connected to the electrical contact, and the other terminal of the heating element is electrically connected to the mounting base or the cover, and an insulating washer is provided between the electrical contact and the mounting base.

The present disclosure further provides an atomizer, including the above atomizing head, wherein the atomizing head is provided inside the atomizer.

The present disclosure further provides an electronic cigarette, including the above atomizer and a power supply assembly for supplying power to the atomizer.

In the heating device for the atomizing head of the electronic cigarette according to the present disclosure, since the liquid absorbing component in the heating device is formed by at least two liquid absorbing elements engaging each other, it is only required to position the liquid absorbing elements of the liquid absorbing component on the outer surface the heating element and engage the liquid absorbing elements together during assembling, rather than rotating to insert the heating element into the integral liquid absorbing component from one end of a through hole in the integral liquid absorbing component as has been done conventionally. In the conventional way, when the difference between the sizes of the external diameter of the heating element and the inner diameter of the through-hole of the liquid absorbing component is too large, it is difficult to assemble. The present disclosure can prevent the problem that it is difficult to insert the heating element into the liquid absorbing component since their sizes are too close to each other, or their sizes are not fit for each other. The present disclosure is not only easy to assemble, but can also improve the efficiency of assembling.

DESCRIPTION OF REFERENCE SIGNS

Figure 1:
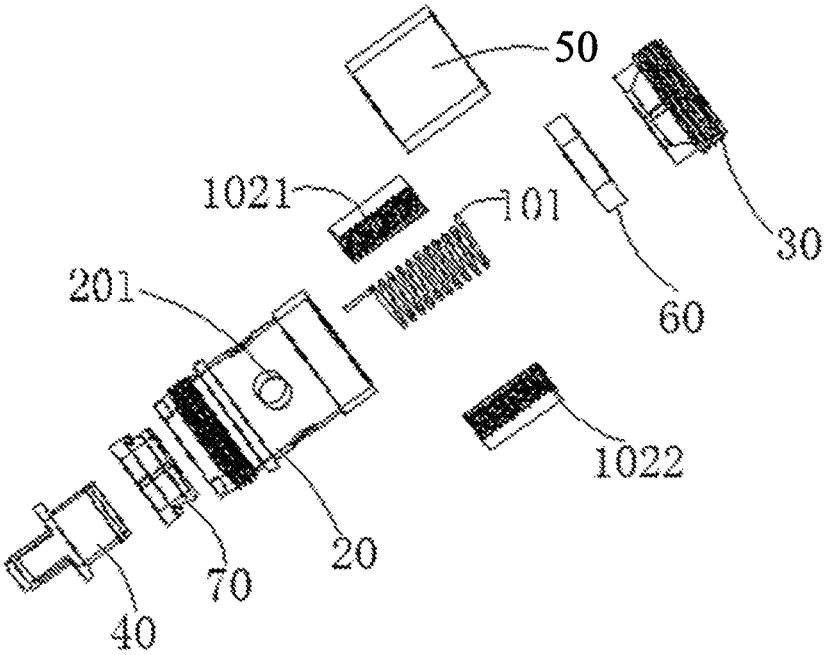
FIG. 1 is a 3D exploded view of an atomizing head according to one embodiment of the present disclosure.

1: atomizing head
10: heating device
101: heating element
102: liquid absorbing component
1021: first curved portion
1022: second curved portion
20: mounting base
201: inlet passage
30: cover
40: electrical contact

50: cotton cloth positioning element
60: seal component
70: insulating washer The present disclosure will be further illustrated by the following detailed embodiments taken in conjunction with the accompanying drawings.

DETAILED DESCRIPTION

The present disclosure will now be further described with reference to the accompanying drawings and specific embodiments, so that those skilled in the art will better understand and practice the disclosure, but the embodiments are not as limiting for the disclosure.

In the absence of the contrary description, the orientation nouns "outer" and "inner" used in the present disclosure are directed to the structure of the heating element, the liquid absorbing component and the mounting base in embodiments of the present disclosure.

Figure 2:
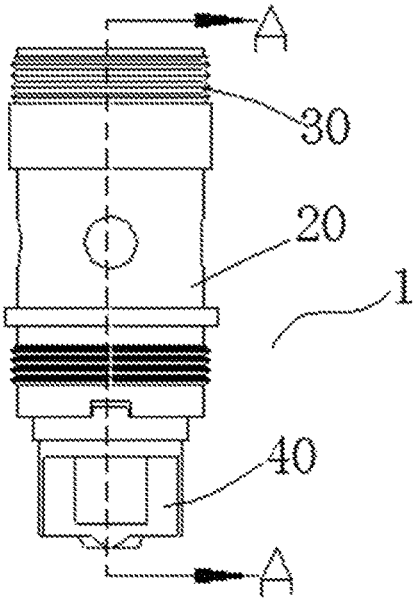
FIG. 2 is a front view of the atomizing head according to the embodiment of the present disclosure
Figure 3:
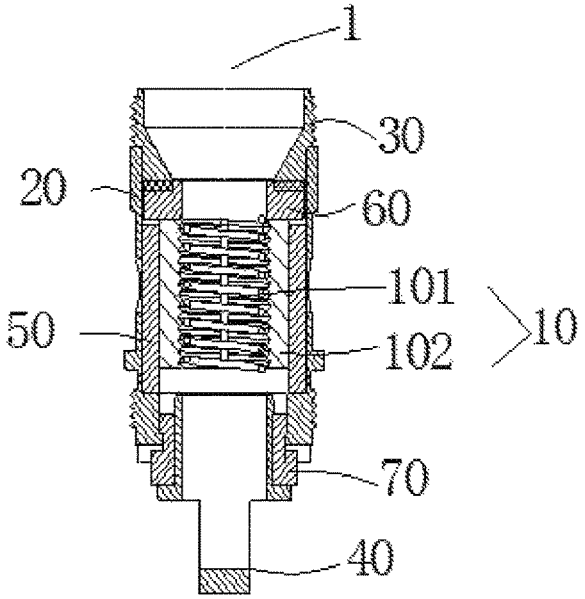
FIG. 3 is a sectional view of the atomizing head shown in FIG. 2 in the direction of A-A.

As shown in FIGS. 1, 2 and 3, a heating device 10 for an atomizing head of an electronic cigarette is provided, including a sleeve-shaped heating element 101 and a liquid absorbing component 102 wrapping around the outer surface of the heating element, wherein the liquid absorbing component 102 is formed by at least two liquid absorbing elements engaging each other.

The heating element 101 is in a sleeve shape, and the liquid absorbing component 102 is wrapping around the outer surface of the heating element 101, that is, the liquid absorbing component 102 is also in a sleeve shape and fitted with the heating element 101. The liquid absorbing component 102 is used to absorb and store the tobacco liquid. After the heating element 101 is powered, the heating element 101 can heat the tobacco liquid in the liquid absorbing component 102 to atomize the tobacco liquid. The inner cavity of the heating element 101 is a passage for smoke and air flow. In this embodiment, since the liquid absorbing component 102 is formed by at least two liquid absorbing elements that engage each other, the liquid absorbing elements of the liquid absorbing component 102 can be positioned on the outer surface of the heating element 101 and engage each other, rather than rotating to insert the heating element into the integral liquid absorbing component from one end of a through hole in the liquid absorbing component as has been done conventionally. In the conventional way, when the difference between the sizes of the external diameter of the heating element and the inner diameter of the through-hole of the liquid absorbing component is too large, it is difficult to assemble. The present disclosure can prevent the problem that it is difficult to insert the heating element 101 into the liquid absorbing component 102 since their sizes are too close to each other, or their sizes are not fit for each other. In addition, since the liquid absorbing component 102 is formed by a plurality of liquid absorbing elements, compared with an integral liquid absorbing component, the single liquid absorbing component is easier to manufacture.

In this embodiment, the heating element 101 is a spiral- and sleeve-shaped heating wire, and the liquid absorbing component 102 is formed by two liquid absorbing elements engaging each other. Specifically, the liquid absorbing component includes two curved liquid absorbing elements, and the curved liquid absorbing elements engage each other to form a sleeve and wrap around the outer surface of the heating element 101. The engagement of the two curved elements is faster than the engagement of three or more curved elements. According to the size of the existing atomizing head, it is easy to manufacture two curved element, with easy control to their sizes.

Specifically, as shown in FIG. 1, the liquid absorbing component 102 includes a first curved portion 1021 and a second curved portion 1022 that can be combined into a sleeve. To facilitate assembling and fastening, the inner surface of the liquid absorbing component 102 is provided with a mounting structure for fastening the heating element 101, for example, a groove is provided on the inner surfaces of the first curved portion 1021 and the second curved portion 1022, respectively, so that a part of the heating element 101 can be inserted in to the groove to fasten the heating element 101 to the liquid absorbing component 102. The liquid absorbing component 102 may also be provided with other structures to the groove, if such structures are able to affix the heating element 101 to the liquid absorbing component 102.

More specifically, in this embodiment, since the heating element 101 is a spiral- and sleeve-shaped heating wire, the inner surfaces of the first curved portion 1021 and the second curved portion 1022 are respectively provided with a spiral groove with the same spiral direction as that of the heating wire. During assembling, the heating wire engages the spiral grooves of the first curved portion 1021 and the second curved portion 1022, so that the liquid absorbing component 102 can wrap around the outer surface of the heating element 101. The assembly is quick and simple. Preferably, according to a preferred implementation of the this embodiment, the portions of the first curved portion 1021 and the second curved portion 1022 that engage each other may be provided with a concave structure and a convex structure matching the concave structure in the axial direction of the heating wire, respectively. The concave structure can engage the convex structure to connect the first curved portion 1021 and the second curved portion 1022 together. In this way, the first curved portion 1021 and the second curved portion 1022 can be fastened together more firmly, without abnormal sound vibration when carried by a walking user.

It should be understood that the liquid absorbing component 102 may be formed by two, three, four or more liquid absorbing elements as long as the liquid absorbing component 102 formed by these liquid absorbing elements is capable of wrapping around the heating element 101. The component parts of the liquid absorbing component 102 may be joined together in various ways, for example, in any suitable manner such as snap-fit, thread join, and muff coupling. Furthermore, the engagement between the component parts may be in the axial direction of the sleeve-shaped heating wire, in the radial direction of the sleeve-shaped heating wire, or in a direction along a curved line.

Preferably, in this embodiment, the liquid absorbing component 102 is made of a porous ceramic material, and the porous ceramic material can not only absorb the tobacco liquid, but also store a part of the tobacco liquid. In this way, even if the tobacco liquid is used up, no peculiar smell will be produced to affect the user experience.

According to another aspect of the present disclosure, an atomizing head 1 of an electronic cigarette is also provided, including a mounting base 20 and a heating device 10 in the foregoing embodiment. The heating device 10 is provided inside the mounting base 20, and the mounting base 20 is provided with an inlet passage 201 for guiding the tobacco liquid to the liquid absorbing component 102. Since the inlet passage 201 is provided on the mounting base 20, the tobacco liquid can enter the liquid absorbing component 102 of the heating device 10 through the liquid inlet passage 201, and then the tobacco liquid is heated and atomized by the heating element 101 of the heating device 10.

As shown in FIGS. 2 and 3, in this embodiment, the mounting base 20 is in a hollow sleeve-shaped device having upper and lower openings, and the heating device 10 is housed inside the mounting base 20. The liquid inlet passage 201 is a through-hole through the side wall of the mounting base 201. It should be noted that the shape of the liquid inlet passage 201 is not limited, for example, it can be, but is not limited to a circular hole or a polygonal hole penetrating through the side wall of the mounting base 20.

Furthermore, in this embodiment, the positioning element 50 for fastening the liquid absorbing component 102 of the heating device 10 is provided between the mounting base 20 and the heating device 10, that is, the positioning element 50 is provided between the inner surface of the mounting base 20 and the outer surface of the liquid absorbing component 102. By providing the positioning element 50, it is possible to prevent the positional displacement of the component parts of the liquid absorbing component 102 and the positional displacement of the entire liquid absorbing component 102, thereby increasing the reliability of the assembly. The positioning element 50 may be implemented in a variety of forms such as a filler that fills the gap between the mounting base 20 and the liquid absorbing component 102, or a wood block sandwiched between the mounting base 20 and the liquid absorbing component 102, and any other suitable means for fastening the liquid absorbing component 102.

Specifically, in this embodiment, the positioning element 50 is a cotton cloth or cotton wrapping around the outer surface of the liquid absorbing component 102, that is, the cotton cloth or cotton wraps around the outer surface of the heating device 10 to prevent the relative movement between the first curved portion 1021 and the second curved portion 1022. The positioning element 50 for fastening the liquid absorbing component 102 may be provided between the mounting base 20 and the heating device 10 and may encompass the liquid absorbing component 102 such that an inner surface of the positioning element substantially entirely and directly be in contact with an outer surface of the liquid absorbing component. The effect for absorbing the tobacco liquid of the cotton or cotton-made positioning element 50 is stronger than that of the porous ceramic material, which increases the absorption rate of the liquid absorbing component 102, thereby ensuring the amount of smoke that the user continues to use.

As shown in FIGS. 2 and 3, in this embodiment, the length of the mounting base 20 in the axial direction is larger than the length of the heating device 10 in the axial direction, and the heating device 10 is located substantially at the middle of the mounting base 20. Two ends of the mounting base 20 are used as the electrical contacts for mounting the cover 30 and the power supply, respectively.

Specifically, the atomizing head 1 in this embodiment further includes a cover 30 provided on one end of the mounting base 20, and the cover 30 is mounted on one end of the mounting base 20. On the one hand, the cover 30 is used to prevent the heating device 10 from falling off of the mounting base 20, on the other hand, the cover 30 is used to be connected to a vent pipe of the electronic cigarette or other parts, to be further connected to the cigarette holder of the electronic cigarette, to facilitate the usage of the electronic cigarette. The cover 30 is provided with an axial through-hole to communicate with the inner cavity of the heating element 101, and the outer periphery of the cover 30 extending out of the end portion of the mounting base 20 is provided with a thread for connecting the vent pipe of the electronic cigarette or other parts associated with the cigarette holder in a threaded connection. When the cigarette holder is mounted on the electronic cigarette, the smoke can flow along the inner cavity of the heating element 101 through the axial through-hole of the cover 30 to the cigarette holder under the smoking action of the user, and is then be inhaled by the user.

Furthermore, if the tobacco liquid flows through the cover 30 into the cigarette holder, it may be inhaled by user. In order to prevent this problem and retain the liquid absorbing component 102, a seal component 60 is provided between the cover 30 and the liquid absorbing component 102. In this embodiment, the seal member 60 is an O-type silicone washer, and the O-type silicone washer is sandwiched between the liquid absorbing component 102 and the cover 30. During the assembling of the cover 30, the O-type silicone washer is arranged above the liquid absorbing component 102, the cover 30 is mounted above the O-type silicone washer by means of an interference fitting or a threaded connection, and the liquid absorbing component 102 can be fixed firmly through compression caused by the O-type silicone washer.

More specifically, the atomizing head 1 in this embodiment further includes an electrical contact 40 for electrical connection with the anode or cathode of power supply. The electrical contact 40 is connected to the other end of the mounting base 20 that is away from the cover 30. One of the terminals of the heating element 101 is connected to the electrical contact 40 electrically, and the other terminal of the heating element 101 is electrically connected to the mounting base 20 or the cover 30. It can be understood that the other terminal of the heating element 101 is electrically connected to any other conductive components on the mounting base 20 except the electrical contact 4. When the electrical contact 40 is connected to the anode of power supply electrically, that is, the electrical contact 40 is used as the anode, the mounting base 20 or the cover 30 serves as the cathode and connects to the cathode of power supply electrically. Alternatively, the electrical contact 40 is connected to the cathode of power supply electrically, that is, the electrical contact 40 is used as the cathode, the mounting base 20 or the cover 30 serves as the anode and connects to the anode of power supply electrically. In this way, the anode of power supply, the electrical contact 40, the heating element 101, the mounting base 20 or the cover 30, the cathode of power supply can be formed as a circuit-loop. When the electrical contact 40, the mounting base 20, or the cover 30 is connected to the anode and the cathode of power source, the heating element 101 can be heated.

In order to prevent the anode of power supply from being directly connected to the cathode of power supply that the heating element 101 is unable to heat the tobacco liquid, an insulating washer 70 is provided between the electrical contact 40 and the mounting base 20, that is, the electric contact 40 is fastened to the other end of the mounting base 20 through the insulating washer 70. In this embodiment, the insulating washer 70 is a T-shaped insulating ring.

In addition, the outer circumference of the other end of the mounting base 20 is provided with a thread. After the assembly of the atomizing head is completed, the atomizing head can be assembled into the atomizer of the electronic cigarette through the thread of the mounting base 20.

According to a further aspect of the present disclosure, an atomizer is further provided, including an atomizing head 1 described in the foregoing embodiment. The atomizing head 1 is mounted in the atomizer by the thread on the outer periphery of the mounting base 20, that is, the atomizing head 1 is disposed inside the atomizer. The atomizing head 1 can absorb and heat the tobacco liquid to atomize the tobacco liquids.

According to a further aspect of the present disclosure, an electronic cigarette is further provided, including an atomizer described in the foregoing embodiment and a power supply assembly. The power supply assembly supplies power to the atomizer so that the atomizing head 1 can heat the tobacco liquid. The electronic cigarette also includes a cigarette holder, and the cigarette holder is integrated with the atomizer, or the cigarette holder is connected to the atomizer detachably.

Compared with the prior art, the liquid absorbing component 102 of the heating device 10 for the atomizing head of the electronic cigarette according to the present disclosure is formed by at least two liquid absorbing elements that engage each other, so that during assembling, the liquid absorbing elements of the liquid absorbing component 102 can be positioned on the outer surface of the heating element 101 and joined together, rather than rotating to insert the heating element into the integral liquid absorbing component from one end of the through hole in the integral liquid absorbing component as has been done conventionally. In the conventional way, when the difference between the sizes of the external diameter of the heating element and the inner diameter of the through-hole of the liquid absorbing component is too large, it is difficult to assemble. The present disclosure can prevent the problem that it is difficult to insert the heating element 101 into the liquid absorbing component 102 since their sizes are too close to each other, or their sizes are not fit for each other. The present disclosure is not only easy to assemble, but can also improve the efficiency of assembling.

The above-described embodiments are merely preferred embodiments for explaining the present disclosure, and the scope of the present disclosure is not limited thereto. The equivalents or substitutions made by those skilled in the art on the basis of the present disclosure are within the scope of the present disclosure. The scope of the disclosure is defined by the claims.

What is claimed is:

1. An atomizing head of an electronic cigarette comprising:

a mounting base having a sleeve shape;

a cover provided on one end of the mounting base;

a heating device provided inside the mounting base, the heating device comprising:

a sleeve-shaped heating element having a spiral-shaped heating wire; and a liquid absorbing component disposed around an outer surface of the heating element, wherein the liquid absorbing component is formed by at least two curved liquid absorbing elements engaging each other to form a sleeve that wraps around the outer surface of the heating element, wherein a spiral groove is provided in an inner surface of the liquid absorbing component and the spiral-shaped heating wire engages the spiral groove; and a seal component provided between the cover and the liquid absorbing component, wherein the mounting base is provided with an inlet passage on a side wall thereof for guiding tobacco liquid from the electronic cigarette to the liquid absorbing component, wherein a positioning element for fastening the liquid absorbing component is provided between the mounting base and the heating device and encompasses the liquid absorbing component and an inner surface of the positioning element is substantially entirely and directly in contact with an outer surface of the liquid absorbing component, and wherein the seal component is in direct contact with the mounting base and the liquid absorbing component and prevents the tobacco liquid from flowing from the mounting base and/or the liquid absorbing component to the cover.

2. The atomizing head of claim 1, wherein the liquid absorbing component is made of a porous ceramic material.

3. The atomizing head of claim 1, wherein the positioning element is a cotton cloth or cotton disposed around an outer surface of the liquid absorbing component.

4. The atomizing head of claim 1, further comprising:

an electrical contact adapted to be electrically connected to an anode or cathode of a power supply, wherein the electrical contact is connected to other end of the mounting base away from the cover, one terminal of the heating element is electrically connected to the electrical contact, and the other terminal of the heating element is electrically connected to the mounting base or the cover; and an insulating washer provided between the electrical contact and the mounting base.

5. An atomizer comprising the atomizing head of claim 1, wherein the atomizing head is provided inside the atomizer.

6. An electronic cigarette comprising the atomizer of claim 5 and a power supply assembly for supplying electric power to the atomizer.

7. The atomizer head of claim 1, wherein, in an assembled state, a portion of the spiral-shaped heating wire is inserted into the spiral groove in the liquid absorbing component.

* * * * *